US005916389A

United States Patent [19]

Lundström

[11] Patent Number: 5,916,389

[45] Date of Patent: Jun. 29, 1999

[54] METHOD OF PRODUCING A SHEET STEEL PRODUCT SUCH AS A REINFORCEMENT ELEMENT IN A LARGER STRUCTURE

[75] Inventor: Erland Lundström, Luleå, Sweden

[73] Assignee: SSAB Hardtech AB, Lulea, Sweden

[21] Appl. No.: 08/869,326

[22] Filed: Jun. 5, 1997

[30] Foreign Application Priority Data

Jun. 7, 1996 [SE] Sweden ..... 9602257

[51] Int. Cl.[6] ..... C21D 1/06

[52] U.S. Cl. ..... 148/640; 148/643

[58] Field of Search ..... 148/640, 643, 148/639

[56] References Cited

FOREIGN PATENT DOCUMENTS 1490535 11/1977 United Kingdom .
2115728 9/1983 United Kingdom ..... 148/643

*Primary Examiner*—Deborah Yee
*Attorney, Agent, or Firm*—Nils H. Ljungman & Associates

[57] ABSTRACT

A product of sheet steel is formed in a pair of cooled tools when hot and is then hardened to a martensitic structure while still in the tools. In this manner, the tools function as a fixture while the steel is hardening. The steel is kept mild in the areas in which it is to be machined, for example punched. Inserts in the tools are used to prevent rapid cooling of the steel sheet and thereby a martensitic structure in the areas adjacent the inserts. The same effect can be obtained by recesses in the tools so that there will be a gap between the sheet steel and the tools.

18 Claims, 2 Drawing Sheets

FIG. 3
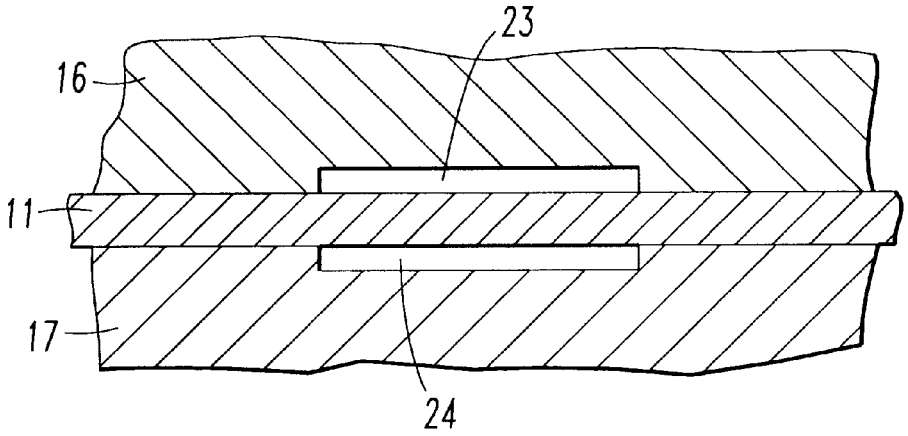
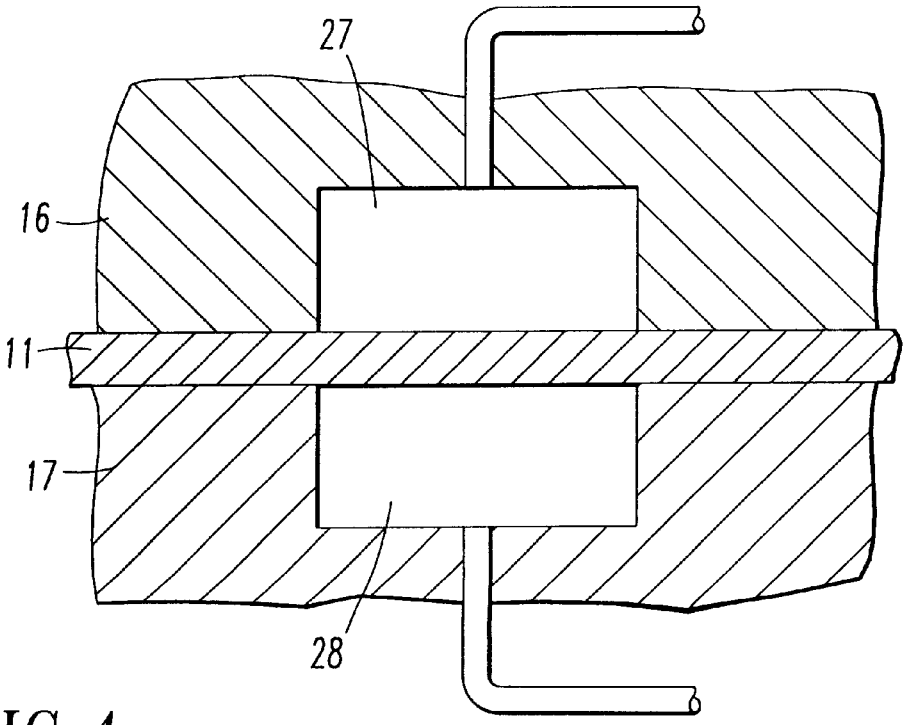
FIG. 4

METHOD OF PRODUCING A SHEET STEEL PRODUCT SUCH AS A REINFORCEMENT ELEMENT IN A LARGER STRUCTURE

BACKGROUND OF THE INVENTION

1. Field of the Invention

The present invention relates to a method of producing a sheet steel product by heating a sized steel sheet, hot forming the steel sheet in a pair of tools and hardening the formed product by cooling it rapidly from an austenitizing temperature while it is still in the pair of tools and then machining the product.

2. Background of the Invention

This method of making hardened sheet steel products is known from GB-149035-A incorporated herein by way of reference and it is called press hardening. A great advantage is that hardened products with complicated form can be produced and still, the tolerances in form and size can be narrow.

In order to reach very high position accuracy of some details, for example holes, slots and the like, a machining operation is carried out on the hardened product. This machining causes high tool wear and may cause reduced fatigue resistance.

OBJECT OF THE INVENTION

It is an object of the present invention to improve the method of producing complicated hardened products by press hardening and subsequent machining and to improve the qualities of the products. This is accomplished in principle in that mild areas are left in the product and the machining is carried out in these mild areas.

SUMMARY OF THE INVENTION

The present invention teaches that this object can be achieved by leaving mild areas in the product and then by carrying out the machining in such mild areas.

In alternative embodiments of the present invention, the machining process referred to herein can also include any equivalent or related process. Examples of such processes which could be incorporated in embodiments of the present invention include, but are not limited to, embossing, inlaying, welding or weld depositing, cold working, punching, reaming and boring.

Another object can be carried out by preventing certain areas from hardening by preventing rapid cooling thereof.

In another embodiment of the present invention, a clearance can be kept between the tools and the areas for preventing rapid cooling thereof.

In yet another embodiment of the invention, the heat insulating inserts in the tools can be kept against the areas for preventing rapid cooling thereof.

In another embodiment of the present invention, the entire product can be hardened in the tools and the areas are then tempered.

In another embodiment of the present invention, the areas can be tempered while the product is still in the tools.

In another embodiment of the present invention, the areas can be tempered when the product has been removed from the tools.

In yet another embodiment of the present invention, the areas can be tempered in connection with the machining or boring or finishing or drilling operation.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention will be described with reference to the accompanying drawings.

FIGS. 3 and 4 shown schematically the same part of the product as in FIG. 2 clamped in modified forming tools.

DESCRIPTION OF THE PREFERRED EMBODIMENTS

Figure 1:
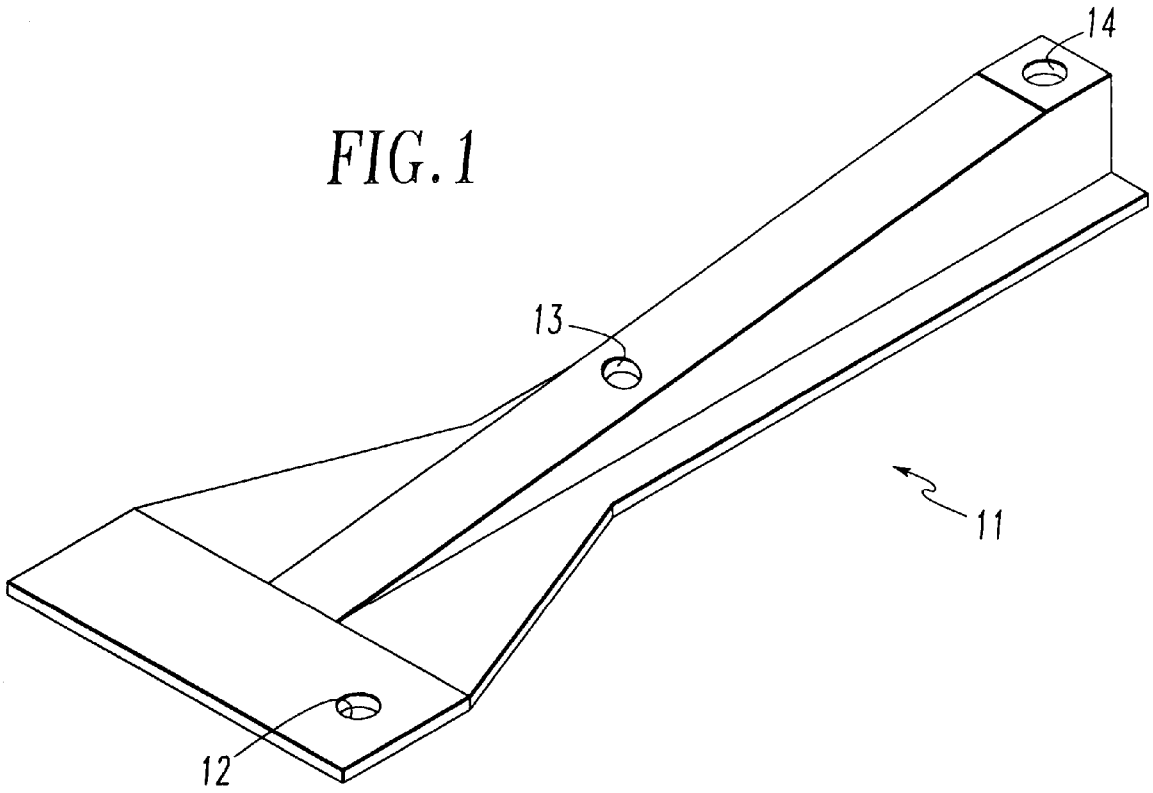
FIG. 1 shows an example of a product produced in accordance with the invention.

The finished product 11 of thin sheet steel shown in FIG. 1 has a complicated form and it has three holes 12, 13, 14 with high demands on accuracy in their positions. The holes 12, 13, 14 can therefore not be made in the flat sheet before the forming but must be made after the forming. The sheet can for example be 1–3 mm thick and the product 11 can for example be a safety bar for car doors.

Figure 2:
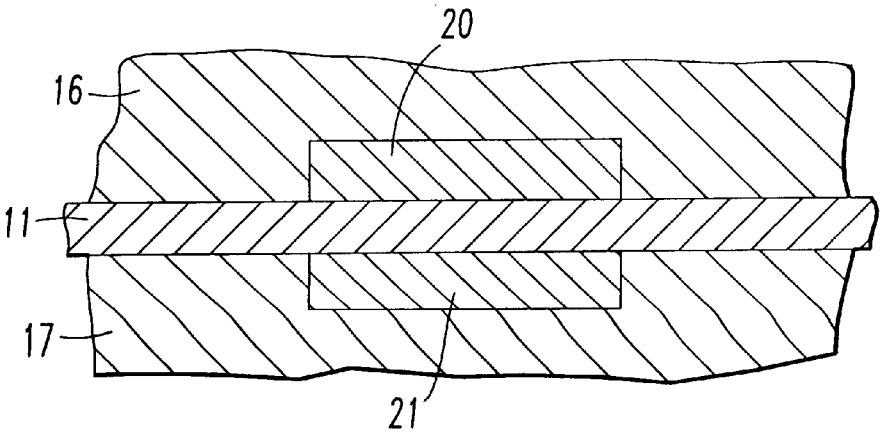
FIG. 2 shows schematically a part of the product shown in FIG. 1 clamped in a pair of forming tools.

In FIG. 2, a part of the product 11 is shown clamped in the corresponding parts of a pair of cooled tools (16, 17) of a press forming machine. The flat cut-to-size sheet is heated in a furnace to a temperature above $Ac_3$, that is, the austenite area. The heated sheet is moved in between the pair of tools 16, 17 and the tools 16, 17 clamp the sheet and forms it in a rapid forming operation. The forming should be so quick that the steel does not harden during the forming operation. Then, the sheet remains in the cooled tools 16, 17 which tools serve as a fixture or support or form or brace after the forming and during the cooling. The cooling should be so rapid that the steel will have a suitable martensitic structure as described in GB-1490535-A and the analysis or makeup or composition of the steel should preferably be as described therein.

Around the areas in which the holes 12, 13, 14 are to be made, there are inserts 20, 21, suitably or preferably ceramic inserts, in the tools 16, 17. These inserts 20, 21 have a lower heat conducting ability than the rest of the tools 16, 17 and they cause the sheet to cool more slowly in these areas than otherwise. In other words, the areas of the sheet adjacent the inserts cools more slowly than the remainder of the sheet. Thus, the sheet hardens less, that is, is less martensitic, or does not harden at all in these areas.

Then, when the holes 12–14 are punched or made in another way, their edges will be more even than they would be if they were punched in a hardened material. There will also be less microcracks. This will have a positive effect on the fatigue strength. The wear of the machining tools will also be reduced which is an advantage economically.

FIG. 3 shows tools 16, 17 which have recesses 23, 24 instead of the inserts 20, 21 in FIG. 2 so that thin clearances are formed between the tools 16, 17 and the sheet 11 in the areas for subsequent machining, that is in the areas in which the holes 12–14 are to be punched. The recesses 23, 24 reduce the cooling effect of the tools 16, 17 and the result will be the same as when the inserts 20, 21 are used, that is, the steel will not transform into martensite at all or will do so at a reduced degree.

FIG. 4 shows an alternative design with induction elements 27, 28 in the tools 16, 17. By induction heating, the rapid cooling can be prevented and the steel can be prevented from hardening in the area of the induction elements.

It still also be possible to permit martensite to form and to then temper the formed martensite by heating the steel by the use of the induction elements 27, 28. It is also possible to heat by other methods than induction heating.

As an alternative to the providing of mild steel areas in the steel directly in the forming tools as described with reference to the FIGS. 2–4, one can have the entire product 11 harden in the tools and then, in a separate process, temper the areas in which the machining is to be carried out. In such a case, the tempering can be carried out in direct connection with the machining operation by using a machine, for example a punch, that has a heating device, for example an induction heating element, built into it.

One feature of the invention resides broadly in a method of making a sheet steel product by heating a sized steel sheet, hot forming the steel sheet in a pair of tools and hardening the formed product by cooling it rapidly from an austenitizing temperature while it is still in the pair of tools and then machining the product, characterized in that mild areas are left in the product and the machining is carried out in such mild areas.

A further feature of the invention resides broadly in preventing said areas from hardening by preventing rapid cooling thereof.

Another feature of the invention resides broadly in keeping a clearance between the tools 16, 17 and said areas for preventing rapid cooling thereof.

Still another feature of the invention resides broadly in keeping heat insulating inserts 20, 21 in the tools against said areas for preventing rapid cooling thereof.

Another feature of the invention resides broadly in that the entire product is hardened in the tools and said areas are then tempered.

Yet another feature of the invention resides broadly in that said areas are tempered while the product is still in the tools.

Still another feature of the invention resides broadly in that said areas are tempered when the product has been removed from the tools.

Another feature of the present invention resides broadly in that said areas are tempered in connection with the machining or boring or finishing or drilling operation.

Examples of steel sheets, and methods for forming steel sheets which may be used in conjunction with embodiments of the present invention may be found in the following U.S. Pat. Nos: 5,382,302; 5,383,592; 5,392,843; 5,407,493; 5,421,969; 5,425,820; 5,431,753; 5,439,165; 5,462,615; 5,467,811; and 5,470,529.

Examples of induction heating devices which may be used in conjunction with embodiments of the present invention may be found in the following U.S. Pat. Nos. 5,378,879; 5,408,072; 5,409,553; 5,411,570; 5,455,402; 5,472,528; and 5,479,436.

Examples of methods and devices for machining metal which may be incorporated in embodiments of the present invention, may be found in the following U.S. Pat. Nos. 5,466,099; 5,385,040; 5,397,420; 5,398,572; 5,417,132; 5,439,431; 5,444,902; 5,447,485; and 5,474,406.

Methods of embossing or inlaying steel which may be incorporated in embodiments of the present invention may be found in the following U.S. Pat. Nos. 5,385,471; 5,391,517; 5,399,217; and 5,432,989.

Examples of metal punches and methods for using metal punches which may be incorporated in embodiments of the present invention may be found in the following U.S. Pat. Nos. 5,377,415; 5,377,519; 5,379,227; 5,388,330; 5,423,199; 5,432,989; 5,435,049; 5,465,473 and 5,475,999.

Examples of low heat conductivity ceramics which may be incorporated in embodiments of the present invention may be found in the following U.S. Pat. Nos. 5,378,144; 5,378,417; 5,380,482; 5,390,843; 5,408,070; 5,411,763; 5,420,395; 5,431,020; 5,451,448; 5,468,358; 5,471,721; 5,476,684; and 5,477,610.

Examples of car doors, and components therein, in which products made by the method of the present invention could be incorporated, may be found in the following U.S. Pat. Nos. 5,277,469; 5,256,219; and 5,093,990.

U.S. Pat. No. 5,600,931, and U.S. patent applications Ser. No. 08/121597, filed on Sep. 14, 1993, with inventor Ernst Kero; Ser. No. 08/409806, filed on Mar. 24, 1995, having the inventor Martin Jonnson; and Ser. No. 08/686269, filed on Jul. 25, 1996, having the inventor Martin Jonnson; and the references cited therein, are hereby incorporated by reference as if set forth in their entirety herein.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Swedish Patent Application No. 9,602,257-9, filed on Jun. 7, 1996, having inventor Erland Lundstr öm, as well as its published equivalents, and other equivalents or corresponding applications, if any, in corresponding cases in Sweden and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

I claim:

1. A method of making a sheet steel product comprising the steps of:

providing a steel sheet of a given size;

providing a tool for holding the steel sheet;

positioning the steel sheet in the tool;

heating the steel sheet to an austenitizing temperature;

hot forming a steel sheet product out of the steel sheet while using the tool;

hardening at least a portion of the steel sheet product to a hardness;

producing at least one mild area in the steel sheet product, the mild area having a hardness substantially less than the hardness of the hardened portion of the steel sheet product; and forming the at least one mild area in the steel sheet product.

2. The method of making a sheet steel product according to claim 1 wherein said step of forming the at least one mild area in the steel sheet product comprises removing at least a section of the at least one mild area in the steel sheet product.

3. The method of making a sheet steel product according to claim 2 wherein said step of hardening at least a portion of the steel sheet product to a hardness comprises rapidly cooling the at least a portion of the steel sheet product.

4. The method of making a steel sheet product according to claim 3 wherein said step of producing at least one mild area in the steel sheet product comprises preventing the at least one mild area from rapidly cooling.

5. The method of making a sheet steel product according to claim 4 wherein said step of providing a tool for holding the steel sheet comprises providing a two-piece tool for holding the steel sheet.

6. The method of making a sheet steel product according to claim 5 wherein said step of removing at least a section of the at least one mild area in the steel sheet product comprises machining the at least one mild area in the steel sheet product.

7. The method of making a steel sheet product according to claim 6 wherein said step of preventing the at least one mild area from rapidly cooling comprises maintaining a distance between the two-piece tool and the at least one mild area in the steel sheet.

8. The method of making a steel sheet product according to claim 6 wherein said step of preventing the at least one mild area from rapidly cooling comprises providing at least one heat insulating portion in the two-piece tool adjacent the at least one mild area.

9. The method of making a steel sheet product according to claim 6 wherein said step of providing at least one heat insulating portion in the two-piece tool adjacent the at least one mild area comprises positioning at least one heat insulating insert in the two-piece tool adjacent the at least one mild area.

10. The method of making a steel sheet product according to claim 9 wherein said step of positioning at least one heat insulating insert in the two-piece tool adjacent the at least one mild area comprises positioning at least one ceramic insert in the two-piece tool adjacent the at least one mild area.

11. The method of making a steel sheet product according to claim 9 wherein said step of positioning at least one heat insulating insert in the two-piece tool adjacent the at least one mild area comprises positioning an induction-cooling element in the two-piece tool adjacent the at least one mild area.

12. The method of making a steel sheet product according to claim 3 wherein said step of producing at least one mild area in the steel sheet product comprises tempering at least one portion of the at least a portion of the steel sheet product.

13. The method of making a sheet steel product according to claim 12 wherein said step of removing at least a section of the at least one mild area in the steel sheet product comprises machining the at least one mild area in the steel sheet product.

14. The method of making a sheet steel product according to claim 13 wherein said step of providing a tool for holding the steel sheet comprises providing a two-piece tool for holding the steel sheet.

15. The method of making a steel sheet product according to claim 14 comprising the step of removing the steel sheet product from the two-piece tool after said step of tempering at least one portion of the at least a portion of the steel sheet product.

16. The method of making a steel sheet product according to claim 14 comprising the step of removing the steel sheet product from the two-piece tool before said step of tempering at least one portion of the at least a portion of the steel sheet product.

17. The method of making a steel sheet product according to claim 16 wherein said step of tempering at least one portion of the at least a portion of the steel sheet product occurs during said step of machining the at least one mild area in the steel sheet product.

18. A method of making a sheet steel product comprising the steps of:

providing a steel sheet of a given size;

providing a tool for holding the steel sheet;

positioning the steel sheet in the tool;

heating the steel sheet to an austenitizing temperature;

hot forming a steel sheet product out of the steel sheet while using the tool;

hardening at least a portion of the steel sheet product to a hardness;

yielding at least one mild area in the steel sheet product substantially simultaneously with the step of hardening at least a portion of the steel sheet product, the mild area having a hardness substantially less than the hardness of the hardened portion of the steel sheet product; and forming the at least one mild area in the steel sheet product.

* * * * *

UNITED STATES PATENT AND TRADEMARK OFFICE

CERTIFICATE OF CORRECTION

PATENT NO. : 5,916,389

DATED : June 29, 1999

INVENTOR(S) : Erland LUNDSTRÖM

It is certified that error appears in the above-identified patent and that said Letters Patent is hereby corrected as shown below:

In column 2, line 23, after '4', delete "shown" and insert --show--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*

US005916389C1

(12) EX PARTE REEXAMINATION CERTIFICATE (7564th)

United States Patent
Lundström

(10) Number: US 5,916,389 C1
(45) Certificate Issued: Jun. 22, 2010

(54) METHOD OF PRODUCING A SHEET STEEL PRODUCT SUCH AS REINFORCEMENT ELEMENT IN A LARGER STRUCTURE

(75) Inventor: Erland Lundström, Luleå(SE)

(73) Assignee: SSAB Hardtech AB, Lulea (SE)

Reexamination Request:
No. 90/009,274, Sep. 11, 2008

Reexamination Certificate for:

| | |
|---|---|
| Patent No.: | **5,916,389** |
| Issued: | **Jun. 29, 1999** |
| Appl. No.: | **08/869,326** |
| Filed: | **Jun. 5, 1997** |

Certificate of Correction issued Mar. 20, 2001.

(51) Int. Cl.
*C21D 1/06* (2006.01)

(52) U.S. Cl. ..... 148/640; 148/643

(58) Field of Classification Search ..... None
See application file for complete search history.

(56) References Cited

U.S. PATENT DOCUMENTS

| | | | |
|---|---|---|---|
| 3,615,927 | A | 10/1967 | Paulson |
| 3,558,367 | A | 1/1971 | Eck |
| 3,703,093 | A | 11/1972 | Komatsu |
| 3,972,744 | A | 8/1976 | Cantrell |
| 4,854,150 | A | 8/1989 | Brown |
| 5,451,276 | A | 9/1995 | Junius |
| 5,769,973 | A | 6/1998 | Smith |

FOREIGN PATENT DOCUMENTS

| | | |
|---|---|---|
| EP | WO9216665 | 10/1992 |
| GB | 1490535 | 11/1977 |

*Primary Examiner*—Terrence R Till

(57) ABSTRACT

A product of sheet steel is formed in a pair of cooled tools when hot and is then hardened to a martensitic structure while still in the tools. In this manner, the tools function as a fixture while the steel is hardening. The steel is kept mild in the areas in which it is to be machined, for example punched. Inserts in the tools are used to prevent rapid cooling of the steel and thereby a martensitic structure in the areas adjacent the inserts. The same effect can be obtained by recesses in the tools so that there will be a gap between the sheet steel and the tools.

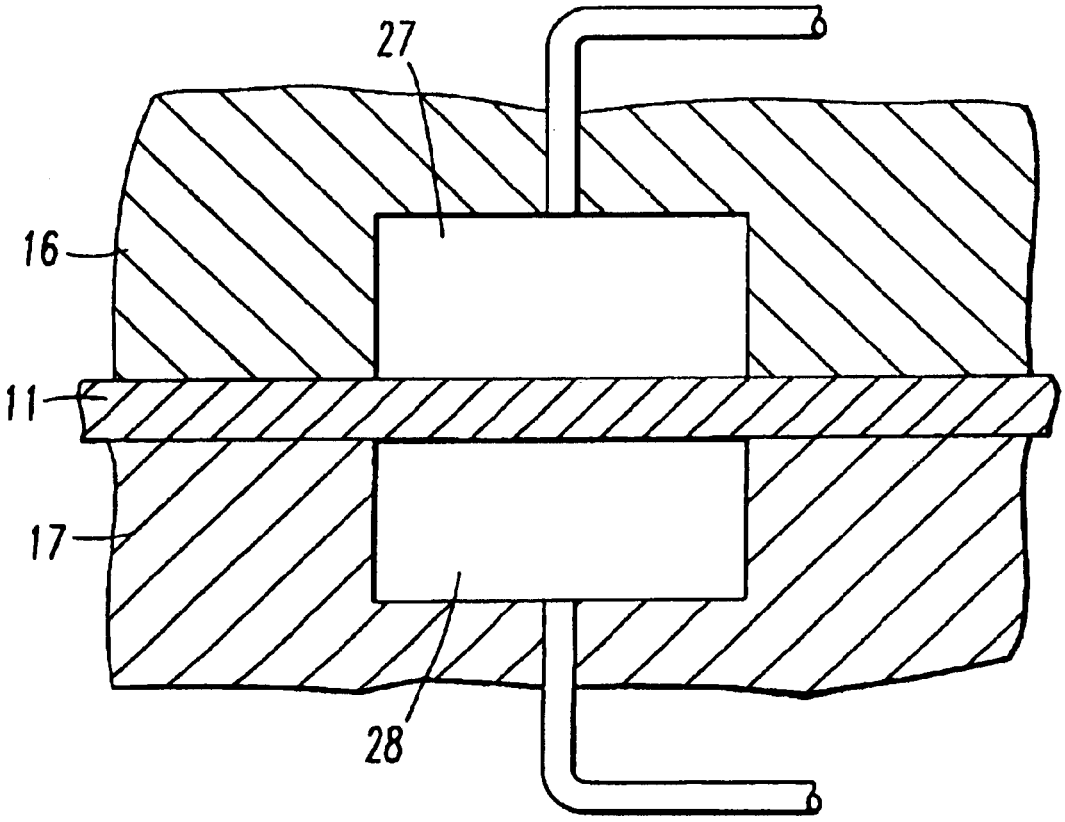

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-18 is confirmed.

* * * * *